US005408852A

United States Patent [19]

Harting et al.

[11] Patent Number: 5,408,852

[45] Date of Patent: Apr. 25, 1995

[54] SYSTEM OF MAGNETS FOR A SELECTION BLOCK IN TEXTILE MACHINES

[75] Inventors: Dietmar Harting, Espelkamp; Ernst-Heinrich Harting, Hess-Oldendorf; Wilhelm Gosewehr, Lübbecke; Wolfgang Neuhaus, Minden; Michael Zwahr, Lübbecke, all of Germany

[73] Assignee: Harting Elektronik GmbH, Espelkamp, Germany

[21] Appl. No.: 171,932

[22] Filed: Dec. 22, 1993

[30] Foreign Application Priority Data

Jan. 8, 1993 [DE] Germany ..... 43 00 291.9

[51] Int. Cl.[6] ..... D04B 15/78; H01F 7/14; H01F 1/12

[52] U.S. Cl. ..... 66/219; 66/221; 335/228

[58] Field of Search ..... 66/218, 219, 221; 335/228

[56] References Cited

U.S. PATENT DOCUMENTS

| | | | |
|---|---|---|---|
| 3,530,686 | 9/1970 | Martinetz . | |
| 3,550,398 | 12/1970 | Widdowson . | |
| 4,790,154 | 12/1988 | Lonati | 66/221 |
| 4,838,049 | 6/1989 | Lonati | 66/221 X |
| 4,856,300 | 8/1989 | Lonati | 66/221 |
| 4,860,557 | 8/1989 | Güell | 66/219 X |
| 4,972,686 | 11/1990 | Maruyama et al. | 66/221 |
| 5,042,274 | 8/1991 | Maruyama et al. | 66/221 X |
| 5,046,334 | 9/1991 | Maruyama et al. | 66/221 |
| 5,095,721 | 3/1992 | Negri | 66/221 |

*Primary Examiner*—John J. Calvert
*Attorney, Agent, or Firm*—Jordan and Hamburg

[57] ABSTRACT

Apparatus for operating needles of a textile machine includes magnetically operated control flaps for operating the needles, and magnetic controls operable to actuate the control flaps. The control flaps include a flap structure and an armature disposed on the flap structure, the magnetic controls being operable to magnetically actuate the armature to thereby effect movement of the flap structure, whereby the movement of the flap structure actuates the needles.

14 Claims, 7 Drawing Sheets

SYSTEM OF MAGNETS FOR A SELECTION BLOCK IN TEXTILE MACHINES

BACKGROUND OF THE INVENTION

The invention relates to a system of magnets for a selection block in textile machines, particularly a bistable system of magnets for selecting needles, magnetically operated control flaps being provided for selecting the needle allocated to the system of magnets, as well as to a selection block with such systems of magnets.

In modern knitting machines (circular knitting machines and flat knitting machines), magnet systems, which are generally combined into so-called selection blocks, are provided for selecting the needles. In order to knit a particular pattern, certain knitting needles must be selected and other needles not at a particular point in time. The selection medium is triggered electronically in modern knitting machines and it is customary to speak of an electronic selection of needles.

The desired pattern is deposited in an electronic memory and is read during the knitting of the textile part, and the needles are selected correspondingly over the interface of the selection block.

In the selection block there are energy converters, which convert the electrical triggering signal into a mechanical change in position of the control flaps, which are required for selecting the needles and protrude from the selection block. The selection blocks generally are supplied with a number of control flaps, each control flap serving one selection plane. Each control flap is provided with a cam, which interacts with needle butts or sinker butts. The control flap can assume two positions, namely, the "basic, non-selecting position" and the "working or selecting position".

In the 'non-selecting' position, the sinker butts run past the control flaps and are not contacted. If a control flap is moved into the 'selecting' position, the allocated sinker butt runs onto the cam and is pressed in the direction of the knitting cylinder or the needle bed. Due to the change in the position of the lifting wire, so accomplished, the condition is created mechanically so that the lifting (selecting) from the 'non-knitting' position into the 'knitting' or 'tucking' position is brought about.

Preferably, small solenoids are used to drive and position the control flaps into the two positions.

Such a selection block is known from the EP-O 219 029-B1. However, when small solenoids are employed, which are inserted as, in themselves, independent magnetic systems into the selection block, only relatively large distances between the control flaps, which are disposed adjacent to one another or one above the other, can be realized. Accordingly, flap intervals (pitch intervals), which are significantly smaller than 5 mm, cannot be realized with the known systems. Finally, the electromagnetic capability of the driving magnets (power, change-over time, dissipated power, service life), required for the application, also depends on the volume of the electromagnet. In minimizing the volume of an optimally dimensioned electromagnet, a lower boundary is rapidly encountered, below which one cannot go. Accordingly, for a particular number of selection planes and for a particular pitch interval, the volume of the selection block is practically specified and cannot just be reduced further.

In the case of the well-known selection block, two bearings are provided for each driving system, namely one bearing for the magnet armature and one for the respective control flap. At both of these bearings, frictional losses occur. An additional place of friction, is the connection site between the magnet armature and the respective control flap, where frictional losses occur. Due to the necessary clearance in the bearings and in the connection site, there is also a not inconsiderable rebounding of the control flaps, as they reach their end positions. This rebounding is greater at higher operating speeds/cycle frequencies of the knitting machine.

In addition, the known system is constructed of a plurality of small magnets, individual parts and components, which must be adjusted specially and make the installation of the selection block expensive and cost intensive.

SUMMARY OF THE INVENTION

An object of the invention therefore is to develop a system of magnets of the initially named type in the direction that the driving power required is reduced and the volume can therefore be reduced. In addition, a simple and inexpensive installation, as well as a reduction in the pitch distance between adjacently disposed magnet systems are to be achieved.

This objective is accomplished owing to the fact that armature of the magnet system is constructed in one piece directly as a control flap.

The advantages, achieved with the invention, consist in particular therein that, due to the omission of a beating as well as of the connecting site between the magnet armature and the control flap, the frictional losses of the system of magnets are decisively reduced, as a result of which, for example, a lesser driving power is required for operating the respective control flap. In the final analysis, this means that the volume of the system of magnets can be reduced, as a result of which, in turn, smaller pitch intervals can be realized.

Furthermore, the inventive system of magnets also has less wear and therefore a longer service life.

In addition, due to the lesser number of bearings/connection sites, there is also less rebounding of the control flaps, so that the system of magnets can be operated at higher cycle speeds.

Finally, due to a simple construction of the system of magnets or of a complete selection block, a reduction in the installation costs is also achieved.

An embodiment of the invention is described in greater detail in the following and shown in the accompanying drawings.

DETAILED DESCRIPTION OF THE PREFERRED EMBODIMENTS

Figure 1C:
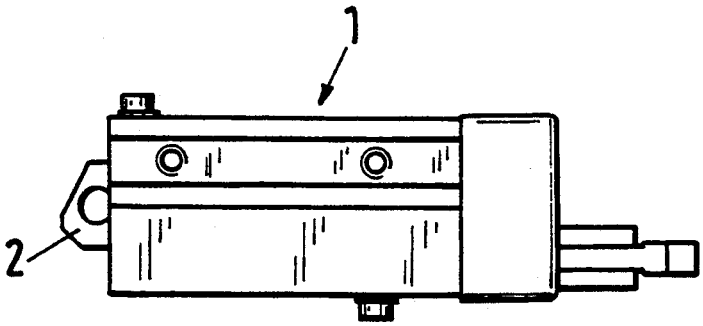
FIGS. 1A, 1B, and 1C show views of a selection block.
Figure 1A:
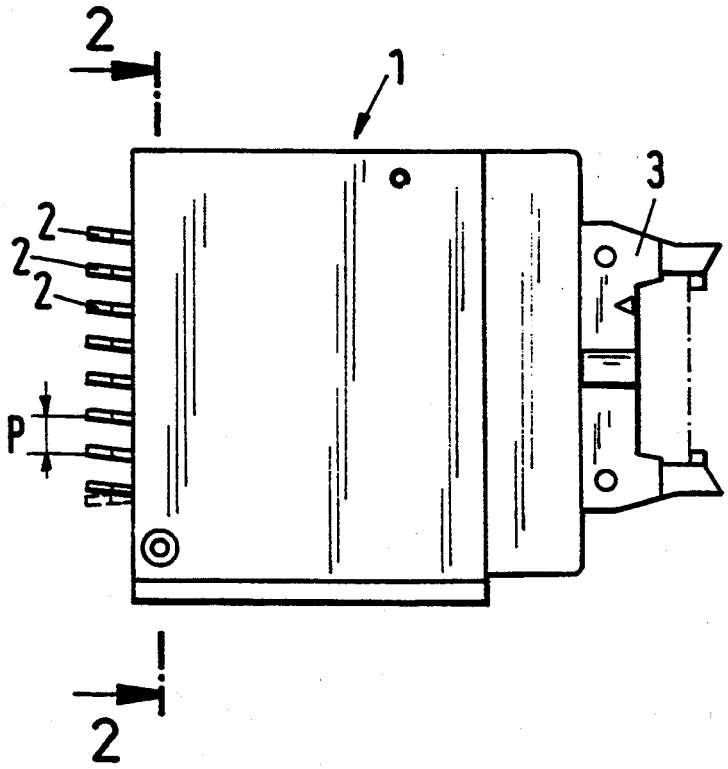
Figure 1B:
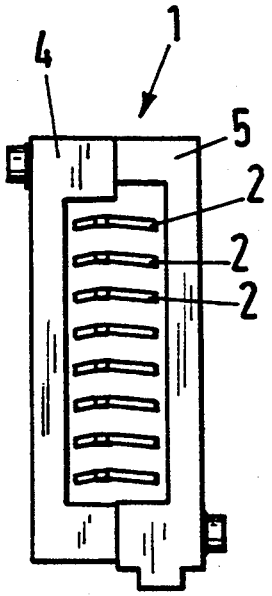

A selection block 1 for a textile machine is shown in various views in FIGS. 1A, 1B, and 1C. The selection block consists essentially of a cuboid housing, in which several systems of magnets are disposed, which in each case affect control flaps 2 for controlling the needles of the textile machine. In the representation of FIG. 1A, the control flaps 2 protrude from the left side of the selection block. On the opposite side, the selection block is provided with a connector 3, over which the electrical signals for operating/controlling the individual systems of magnets are carried.

The control flaps can be moved in each case in two different positions. In the drawing, the second possible position of the lower control flap is indicated by broken lines. The front edge of the control flap covers a distance of about 2 mm. The adjacent control flaps 2 are disposed at pitch intervals P of about 5 mm. In this connection, it should be mentioned here that smaller intervals are also readily possible.

Figure 2:
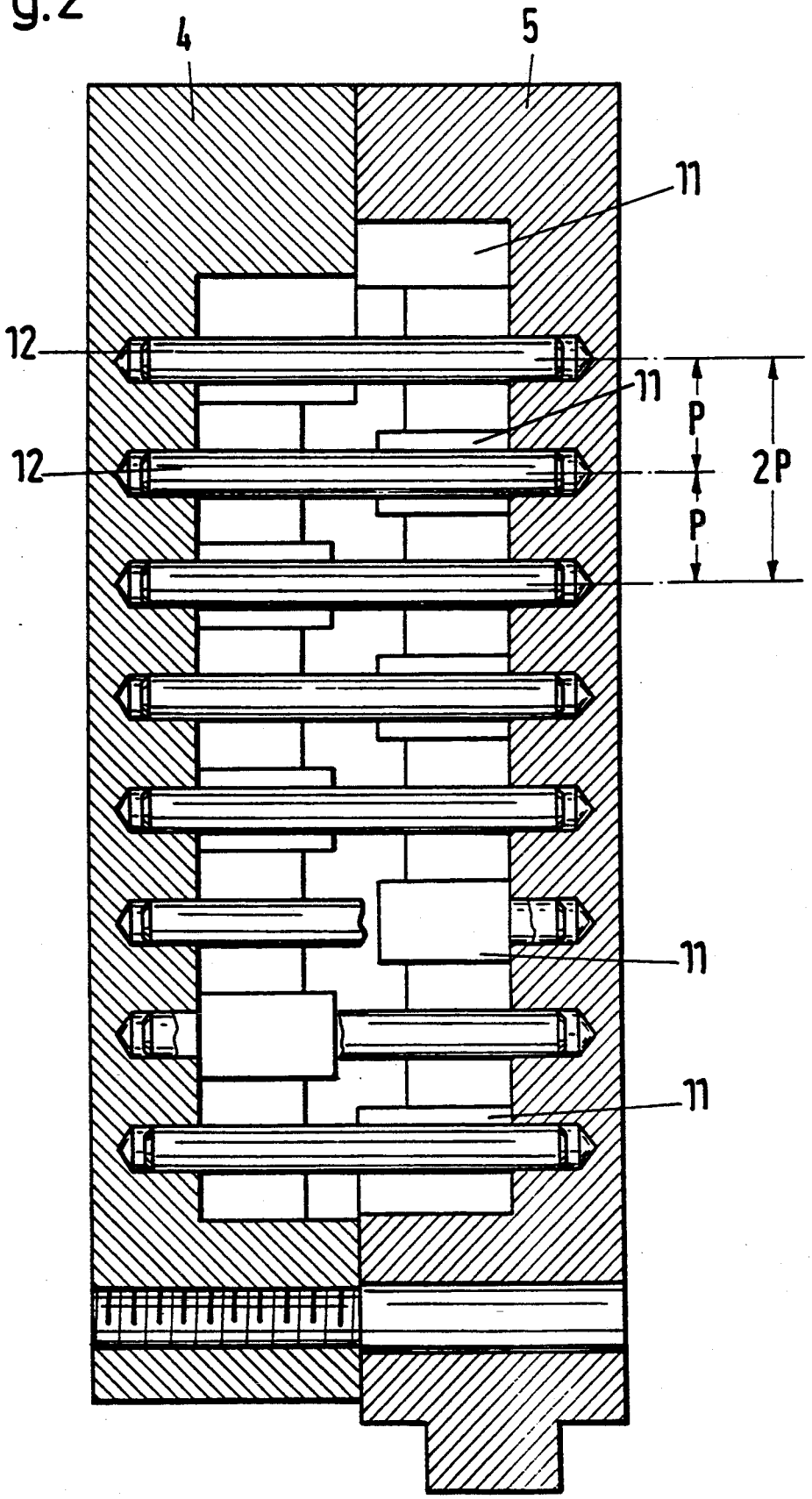
FIG. 2 shows a sectional view of the selection block of FIG. 1 taken along the line 2—2 in FIG. 1A.
Figure 3:
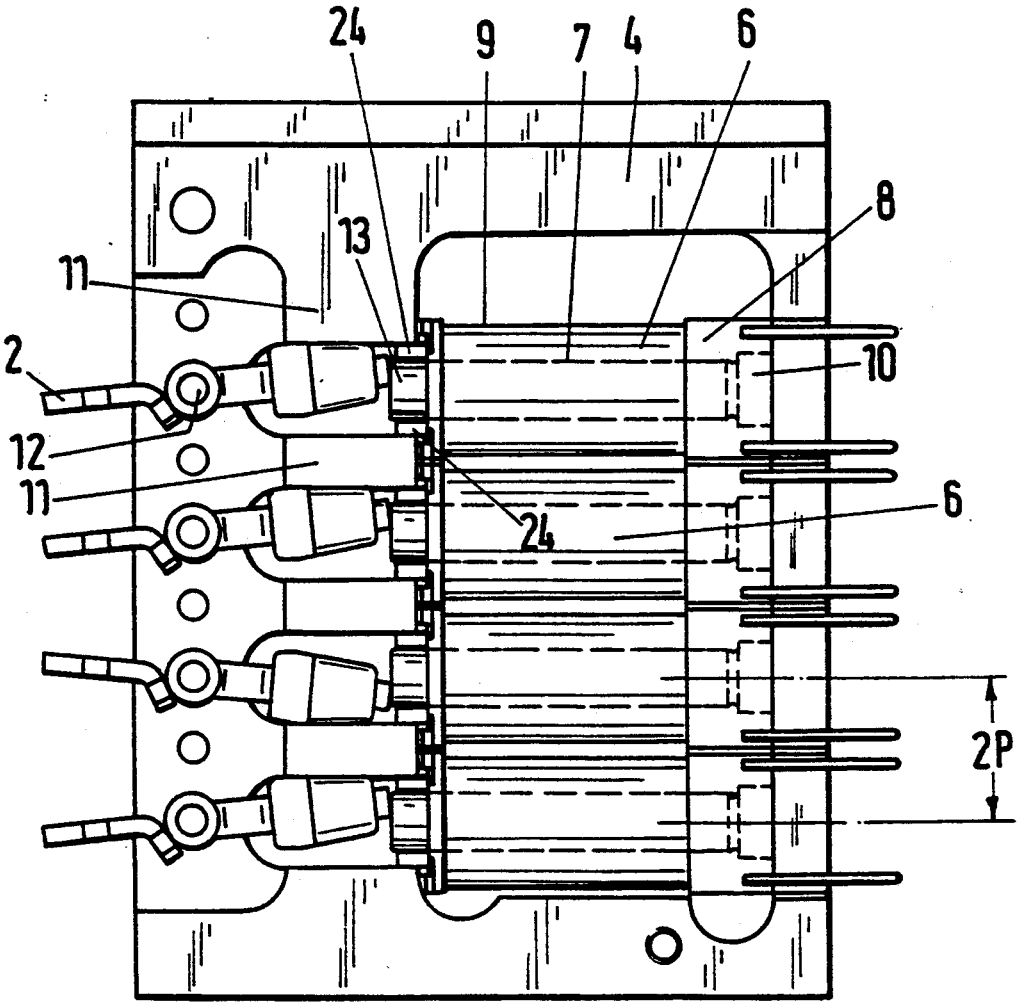
FIG. 3 is a view of an open selection block.

The selection block 1 consists essentially of two half shells 4, 5, in which the magnet systems 6 are inserted. FIG. 2 shows a section through the selection block and FIG. 3 shows a view of the one half shell 4 with the inserted magnet systems.

Figure 4:
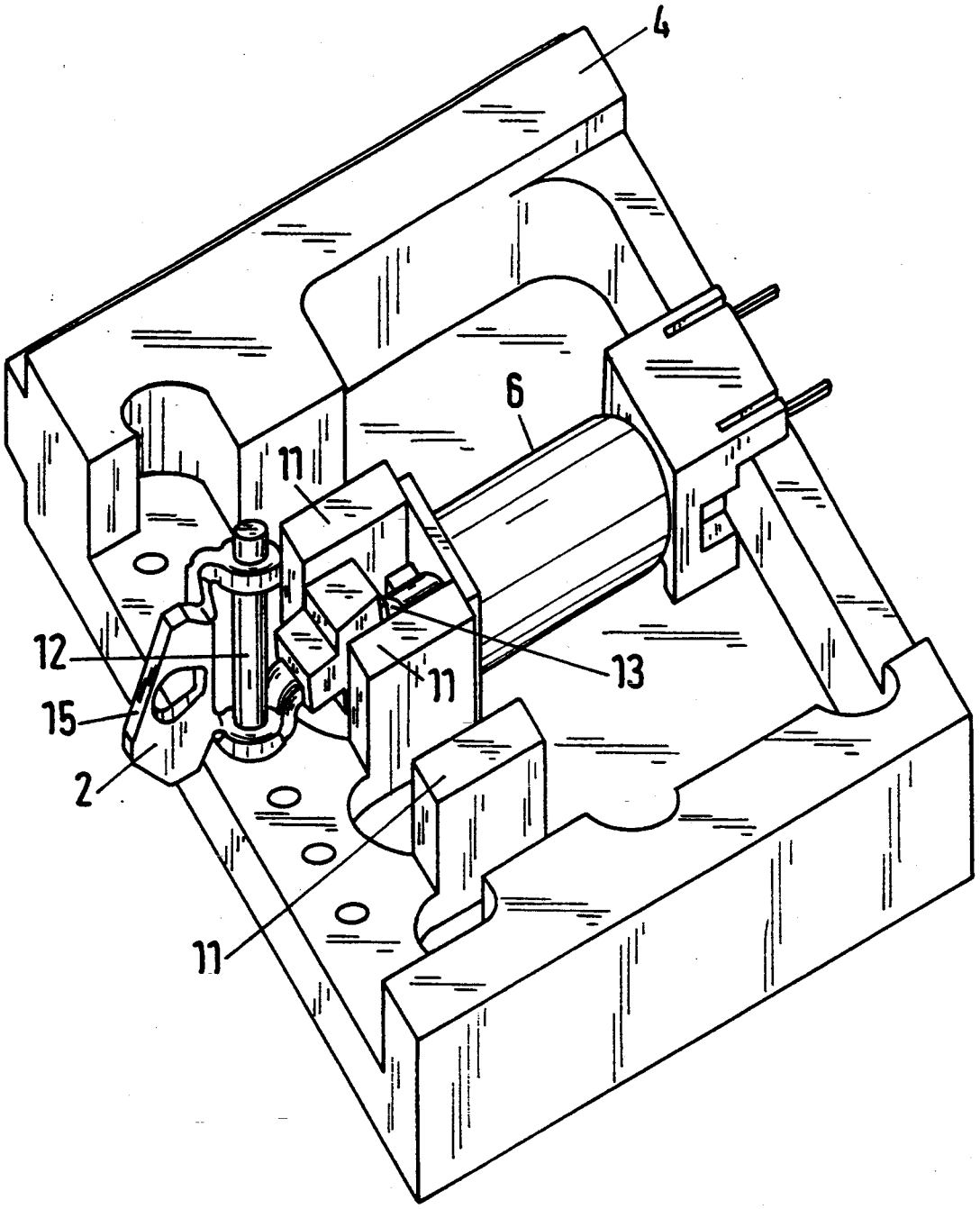
FIG. 4 is a perspective view of an open selection block.

So that the details can be identified better, a half shell, in which only one magnet system is inserted, is shown in perspective view in FIG. 4.

The magnet systems 6 consist essentially of a coil former 8, which is provided with an iron core 7 and on which the exciting winding 9 is wound. The magnet systems are inserted positively into corresponding recesses of the half shell, the lower end of the core being connected in a magnetically conducting manner with the half shell, which consists of a magnetically conducting material. In the front region of the magnet system, lateral pole pieces 11 are constructed in the half shell and also serve as stops for the movement of the control flap 2.

Figure 5B:
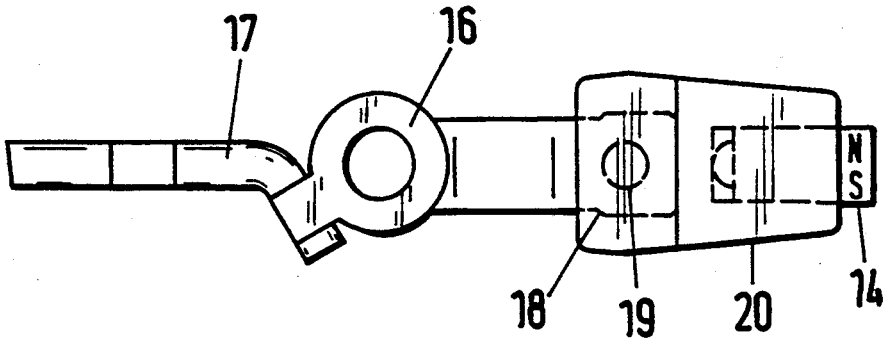
FIGS. 5A and 5B are views of a control flap.
Figure 5A:
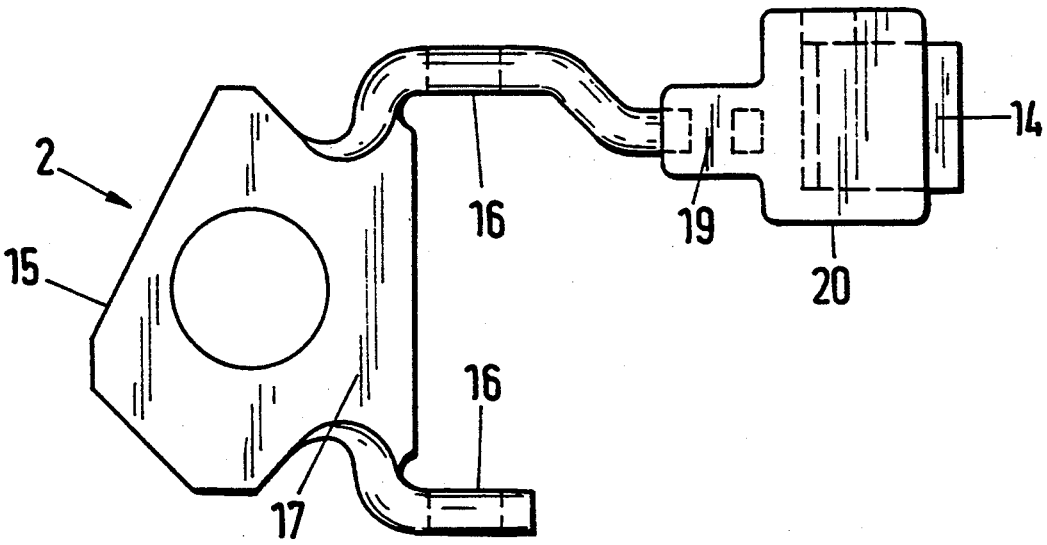

The control flap, which is shown on an enlarged scale in FIGS. 5A and 5B, is mounted so that it can rotate about an axle 12. The end of the control flap, pointing to the end face 13 of the iron core 7 of the magnet system, is provided with a permanent magnet 14.

The polarization direction of this permanent magnet runs transversely to the end face of the iron core 7. Due to the action of the permanent magnet, the end of the control flap, which is provided with the permanent magnet and is disposed between the two pole pieces 11, is initially pulled against one of the two pole pieces and remains there because of permanent magnetic attraction. By supplying the exciting coil of the magnet system by appropriately oriented current, the permanent magnetic attraction to this pole piece is cancelled and the end of the control flap, which is provided with a permanent magnet, is rejected by the adjacent pole piece and attracted by the other pole piece, where it remains also once again due to permanent magnetic attraction, when the exciting current is switched off. At the same time, the front end of the control flap, which is provided with control surfaces 15 for controlling the needles, was moved from a first position into a second position.

The control flap 2, shown in FIGS. 5A and 5B, is a bent component punched out from steel. It is provided with an offset bearing area 16 for accommodating the axle 12 and an offset region 17, at which the control surfaces are formed. The opposite region of the control flap is provided with a contour with undercut 18 and borehole 19. The contour can be sheathed and a plastic pipe 20 is gated to it. The plastic part is provided with a recess, in which a permanent magnet is inserted and fastened.

Figure 6B:
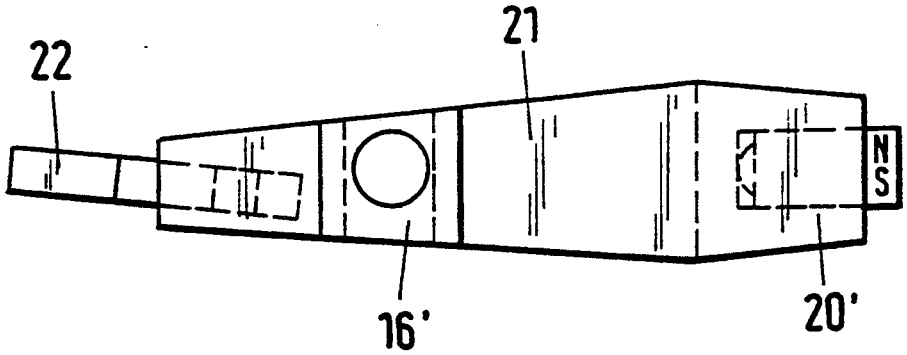
FIGS. 6A and 6B are views of a modified control flap.
Figure 6A:
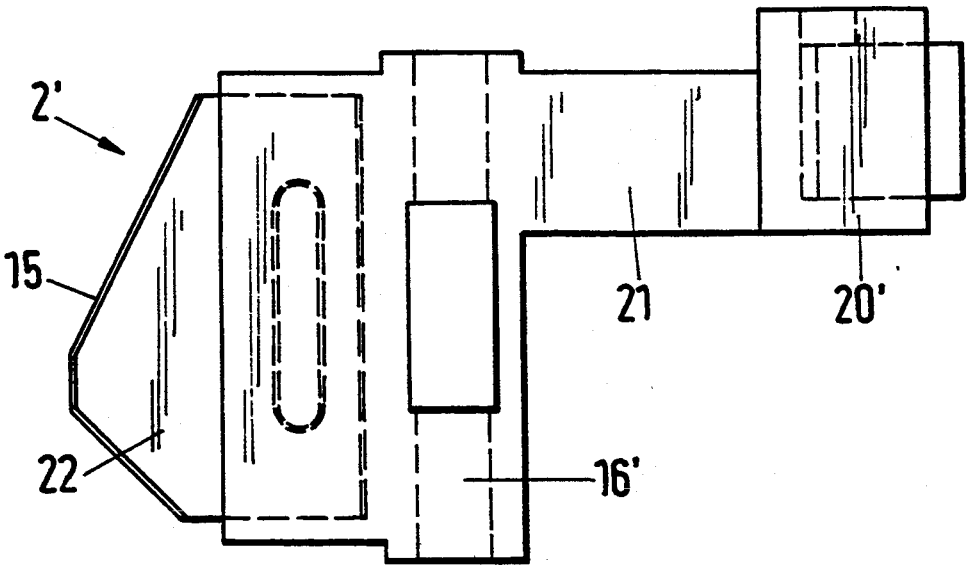

A modified control flap 2' is shown in FIGS. 6A and 6B. A basic body 21, produced by injection molding from a plastic material, is provided here. It contains the plastic part 20' with the recess for accommodating the permanent magnet, as well as the bearing region 16'. A steel part 22, which is provided with the control surfaces 15 for controlling the needles of the knitting machine, is inserted (sheathed) at the front end of the basic body.

Figure 7:
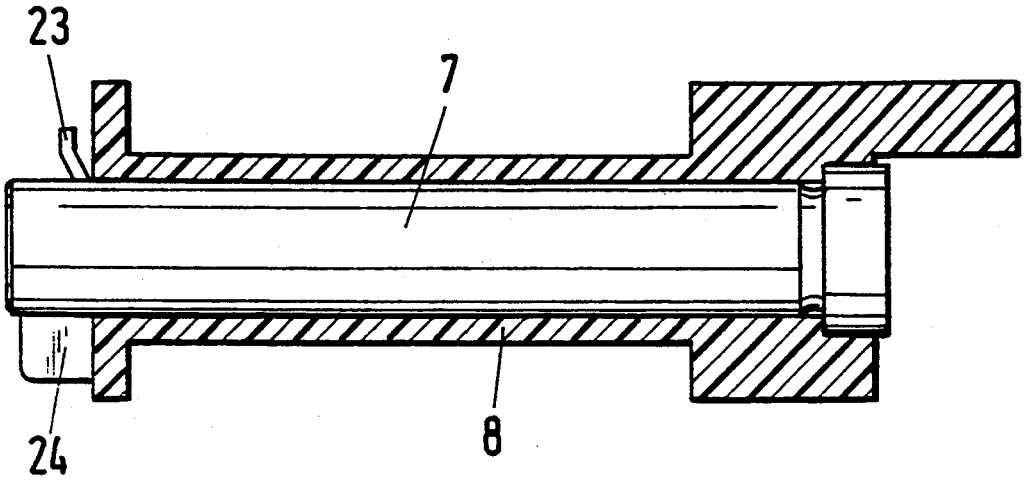
FIG. 7 is a view of a coil former with inserted magnetic core.

The coil former 8 with the iron core 7 of the magnet system is shown in FIG. 7 in sectional representation. The coil former is injection molded from plastic and provided with gated snap-in pins 23 and centering means 24. When the coil former/the system of magnets is inserted into the recesses of the half shell, the snap-in pins 23 and centering means 24 lock behind appropriate locking shoulders and hold the system of magnets positioned in the half shell.

The magnet systems are inserted in the half shells at a mutual interval of 2 P. The magnet systems of the one half shell are then offset by the pitch interval P from the magnet systems of the other half shell, so that, when the two haft shells are assembled, the control flaps have a total pitch interval P. Due to this arrangement, it is possible to provide the magnet systems of a half shell, regarded by themselves, at an interval, which is twice the pitch interval P finally achieved. As a result, volume advantages arise for each magnet system.

We claim:

1. Apparatus for operating needles of a textile machine comprising magnetically operated control flaps for operating said needles, magnetic control means operable to actuate said control flaps, said control flaps comprising a flap structure and an armature means disposed on said flap structure, said magnetic control means being operable to magnetically actuate said armature means to thereby effect movement of said flap structure, whereby said movement of said flap structure actuates said needles, a housing means for said magnetic control means, said housing means comprising a first half-shell in which one-half of the magnetic control means are housed and a second half-shell in which the other half of the magnetic control means are housed, the magnetic control means in said first half-shell being operable independently of the magnetic control means in the second half-shell.

2. Apparatus according to claim 1 wherein said magnetic control means comprises a housing means, pivot means pivotally mounting said control flaps on said housing means for pivotable movement about a pivotable axis, said control flaps having a control flap axis which is perpendicular to said pivotal axis and which passes through said pivotal axis, said armature means comprising a permanent magnet having a polarization direction which extends transversely of said control flap axis.

3. Apparatus according to claim 1 wherein said flap structure and said armature means are formed as one piece.

4. Apparatus according to claim 1 wherein said flap structure comprises a pivotal arm and a mounting means, said armature means comprising a permanent magnet which is fixedly mounted on said pivotal arm by said mounting means.

5. Apparatus according to claim 1 wherein said magnetic control means comprises an elongated magnetic core and an exciting coil, said magnetic core having a longitudinal axis and a longitudinal end, said armature means being disposed juxtaposed to said longitudinal end, said armature means having a magnetic polarization which extends transversely of the longitudinal axis of said magnetic core, said control flaps being pivotally movable between first and second positions as said exciting coil is energized and deenergized.

6. Apparatus according to claim 5 wherein said magnetic control means further comprises spaced pole pieces, said armature means being disposed between said spaced pole pieces, said armature means and said pole pieces being magnetically operable during energization and deenergization of said exciting coil to effect movement of said control means between said first and second positions.

7. Apparatus for operating needles of a textile machine comprising magnetically operated control flaps for operating said needles, magnetic control means operable to actuate said control flaps, said control flaps comprising a flap structure and an armature means disposed on said flap structure, said magnetic control means being operable to magnetically actuate said armature means to thereby effect movement of said flap structure, whereby said movement of said flap structure actuates said needles, a housing means for housing said magnetic control means, said housing means comprising a first half-shell in which one-half of the magnetic control means are disposed and a second half-shell in which the other half of the magnetic control means are disposed, said magnetically operated control flaps associated with each magnetic control means being disposed on the respective half-shell on which said magnetic control means is disposed, said first and second half-shells having an assembled disposition in which the magnetically operated control flaps on said first and second half-shells are disposed in linear array with the magnetically operated control flaps in the first half-shell alternating with the magnetically operated control flaps in the second half-shell.

8. Apparatus according to claim 7 wherein said housing means is constructed of magnetic material.

9. Apparatus according to claim 7 wherein the spacing between the magnetically operated control flaps in said first half-shell is designated as a half-shell spacing, the spacing between the magnetically operated control means in said second half-shell being equal to said half-shell spacing, the spacing between the linearly arrayed magnetically operated control means when the first and second half-shells are in said assembled disposition being designated as the pitch spacing, said pitch spacing being one half of said half-shell spacing.

10. Apparatus according to claim 7 wherein the first and second half-shells meet at a parting plane when in said assembled disposition, said magnetic control means in said first half-shell being disposed on one side of said parting alone, said magnetic control means in said second half-shell being disposed on the other side of said parting plane, said flap structure having a pivotal support structure which traverses said parting plane.

11. Apparatus for operating needles of a textile machine comprising magnetically operated control flaps for operating said needles, magnetic control means operable to actuate said control flaps, said control flaps comprising a flap structure and an armature means disposed on said flap structure, said magnetic control means being operable to magnetically actuate said armature means to thereby effect movement of said flap structure, whereby said movement of said flap structure actuates said needles, said magnetic control means comprising an elongated magnetic core and an exciting coil, said magnetic control means further comprising spaced pole pieces, said armature means being disposed between said spaced pole pieces, said armature means and said pole pieces being magnetically operable during energization and deenergization of said exciting coil to effect pivotal movement of said control flaps between said pole pieces.

12. Apparatus according to claim 11 wherein said control flaps are pivotal between first and second positions as said exciting coil is energized and deenergized, said control flaps having an end portion disposed between said spaced pole pieces, said spaced pole pieces being engageable by said end portions of said control flaps such that said pole pieces serve as stops to define said first and second pivotal positions of said control flap.

13. Apparatus according to claim 12 wherein said armature means is fixedly mounted on said end portion of said control flap.

14. Apparatus according to claim 11 wherein said magnetic core has a longitudinal terminating end juxtaposed to a terminating end of said control flap, said control flap being pivotable about a pivotal axis, said pole pieces being disposed between said pivotal axis and said terminating end of said control flap.

* * * * *